US005548977A

United States Patent [19]

Uchida

[11] Patent Number: 5,548,977

[45] Date of Patent: Aug. 27, 1996

[54] LUBRICATING METHOD AND APPARATUS FOR A CIRCULAR KNITTING MACHINE

[75] Inventor: Kazuya Uchida, Tokyo, Japan

[73] Assignee: Lube Corporation, Tokyo, Japan

[21] Appl. No.: 210,556

[22] Filed: Mar. 18, 1994

[51] Int. Cl.[6] ..... D04B 35/28

[52] U.S. Cl. ..... 66/8; 184/6.1

[58] Field of Search ..... 66/8, 168; 184/6.1

[56] References Cited

U.S. PATENT DOCUMENTS

| | | | |
|---|---|---|---|
| 1,483,844 | 2/1924 | Drumheller . | |
| 4,693,282 | 9/1987 | Campbell | 139/1 R |
| 4,718,253 | 1/1988 | Lonati | 66/8 |
| 4,719,768 | 1/1988 | Lonati | 66/8 |

FOREIGN PATENT DOCUMENTS

| | | | |
|---|---|---|---|
| 0499810 | 1/1992 | European Pat. Off. . | |
| 0499810 | 8/1992 | European Pat. Off. | F16N 25/04 |
| 3007255 | 2/1980 | Germany . | |
| 3624982 | 7/1986 | Germany . | |

*Primary Examiner*—John J. Calvert
*Attorney, Agent, or Firm*—Moore & Van Allen; Richard W. Evans; Michael G. Johnston

[57] ABSTRACT

A lubricating method and apparatus for a circular knitting machine which involves inputting operating conditions for the circular knitting machine from an operating conditions input device 30, after which a pump squirt quantity per squirt is computed by a squirt quantity computing device 33 and set in a squirt quantity setting device 21, a pump squirt velocity is computed by a squirt velocity computing device 34 and set in a squirt velocity setting device 22, and an intermittent pump operating period is computed by an intermittent period computing device 35 and set in an intermittent period setting device 24. Subsequently, a start signal is sent from a start signal sending device 25 after each set intermittent period, and a pump drive device 23 drives the pump 12. As a result, an appropriate quantity of lubricating oil is squirted from a nozzle 13 towards a cam groove 4 of a cam 5 for a duration of at least one revolution of a row of needles 1 of the circular knitting machine. Wastage of lubricating oil can thus be reduced to an insignificant amount, and the lubricating oil can be spread uniformly to all required locations without lubricating oil contamination of the surroundings, thereby preventing nonuniform lubrication and ensuring machine durability.

10 Claims, 6 Drawing Sheets

LUBRICATING METHOD AND APPARATUS FOR A CIRCULAR KNITTING MACHINE

BACKGROUND

This invention relates to a lubricating method and apparatus for a circular knitting machine, and more particularly to a method and apparatus for the continuous lubrication of circular knitting machines for knitting generally tubular articles such as underwear and socks.

In general, a circular knitting machine comprises a plurality of needles arranged in a substantially circular row around the periphery of the machine. A rotating shaft is provided interior of and in engagement with the row of needles so as to revolve the needles around the periphery of the machine. A drum-shaped cam having a cam groove is disposed exterior of the row of needles. Projections protruding from the needles engage the cam groove so as to move the needles back and forth as the row of needles revolves. A cam holder is provided around the cam so as to fixedly hold the cam.

With such an arrangement, the needles arranged in a row around the periphery of the machine are moved back and forth with rotation of the shaft so that threads supplied from a thread supply source mounted above the machine base are knitted to produce a tubular knitted article which is discharged from a central region of the rotating shaft.

Conventionally, lubrication of circular knitting machines involves a method wherein lubricating oil is continuously supplied to the cam groove of the cam in the form of a mist via pressurized air delivery. This conventional mist lubricating method for a circular knitting machine, while having good lubrication performance, has a drawback in that practically all of the lubricating oil is scattered away from the lubrication location. Hence not only is there the undesirable effect of excessive lubricant wastage, but also there are environmental pollution problems such as damage to the knitted product and contamination of the surroundings due to the dispersed mist. Moreover, since a compressor is necessary to supply compressed air for creating the mist, equipment costs are substantial.

Another method for lubricating circular knitting machines which does not have the problems that are associated with mist oiling involves providing a nozzle in the cam holder for airless spraying of lubricating oil directly into the cam groove of the cam. The lubricating oil is sprayed intermittently in a pulsing fashion from the nozzle. This lubrication apparatus injects a fixed amount of oil for much less than a revolution of the needle assembly or row of needles. Although intermittent oil supply reduces wastage of the lubricating oil, the disadvantage is that lubricating oil is not spread equally to the projections of all of the needles passing around the cam groove. This results in nonuniform lubrication of the parts, and the machine thereby becomes susceptible to failure such as seizing, and reduced durability.

For the foregoing reasons, there is a need for a method and apparatus for the continuous supply of lubricating oil to a circular knitting machine by a means other than pressurized air. There is also a need to provide a lubricating method and apparatus for a circular knitting machine which can reduce wastage of lubricating oil to an insignificant amount, and which can spread the lubricating oil uniformly to all required locations without lubricating oil contamination of the surroundings, thereby preventing nonuniform lubrication and ensuring machine durability.

SUMMARY

The present invention is directed to a method and apparatus that satisfies these needs. The method for lubricating a circular knitting machine according to the present invention comprises periodically squirting lubricating oil into the cam groove of the cam of the machine to lubricate said projections and cam groove. The lubricating oil is squirted continuously for a duration of at least one revolution of the row of needles.

The apparatus for lubricating the circular knitting machine according to the present invention comprises a nozzle provided on the cam holder for squirting lubricating oil into the cam groove of the cam, a pump for supplying lubricating oil to the nozzle, and a pump drive control for intermittent drive control of the pump so as to periodically squirt lubricating oil from the nozzle continuously for a duration of at least one revolution of the row of needles.

The pump drive control effectively comprises a squirt quantity setting device for setting a pump squirt quantity per squirt, a squirt velocity setting device for setting a pump squirt velocity, and a means for setting an intermittent pump operating period between successive squirts of oil. The pump drive control further comprises a start signal sending device for sending a start signal after each intermittent period, a stop signal sending device for sending a stop signal after the completion of one squirt and a pump drive device which starts at the time of said start signal and stops at the time of said stop signal and which provides said squirt quantity and said squirt velocity.

The drive control section may further comprise an operating conditions input device for manually inputting operating conditions of the circular knitting machine, a squirt quantity computing device for computing squirt quantity per one squirt on the basis of the operating conditions input, a squirt velocity computing device for computing a squirt velocity on the basis of the operating conditions input, and an intermittent period computing device for computing an intermittent period on the basis of the operating conditions input.

Another embodiment of the present invention comprises a drive control section having a revolution speed detection device for detecting the revolution speed of the row of needles and a squirt velocity computing device for computing a squirt velocity on the basis of the revolution speed detected by the revolution speed detection device, which is set in the squirt velocity setting device.

By the method and apparatus of the embodiments of the present invention, lubricating oil is squirted into the cam groove for a duration of at least one revolution of the row of needles, so that the lubricating oil is supplied to the projections on all of the needles. Consequently, the lubricating oil is uniformly spread, and the condition of nonuniform lubrication is prevented. Furthermore, when the squirt quantity, squirt velocity and intermittent pump operating period between successive squirts of oil are set by means of the drive control section, the pump drive device drives the pump automatically so as to give the squirt quantity and squirt velocity. Therefore, the lubricating oil can be reliably supplied to the cam groove. Moreover, when the circular knitting machine operating conditions are entered or inputted and the squirt quantity, squirt velocity and intermittent period are thereby computed, the appropriate lubrication to suit the circular knitting machine operating conditions is automatically carried out.

BRIEF DESCRIPTION OF THE DRAWINGS

These and other features, aspects, and advantages of the present invention will become better understood with regard to the following description, appended claims, and accompanying drawings where:

DESCRIPTION

The following is a description of the embodiments of a lubricating method and apparatus for a circular knitting machine according to the present invention, based on the accompanying drawings. The method for lubricating a circular knitting machine is necessarily affected by the lubricating apparatus for the circular knitting machine in accordance with the embodiments.

Figure 5:
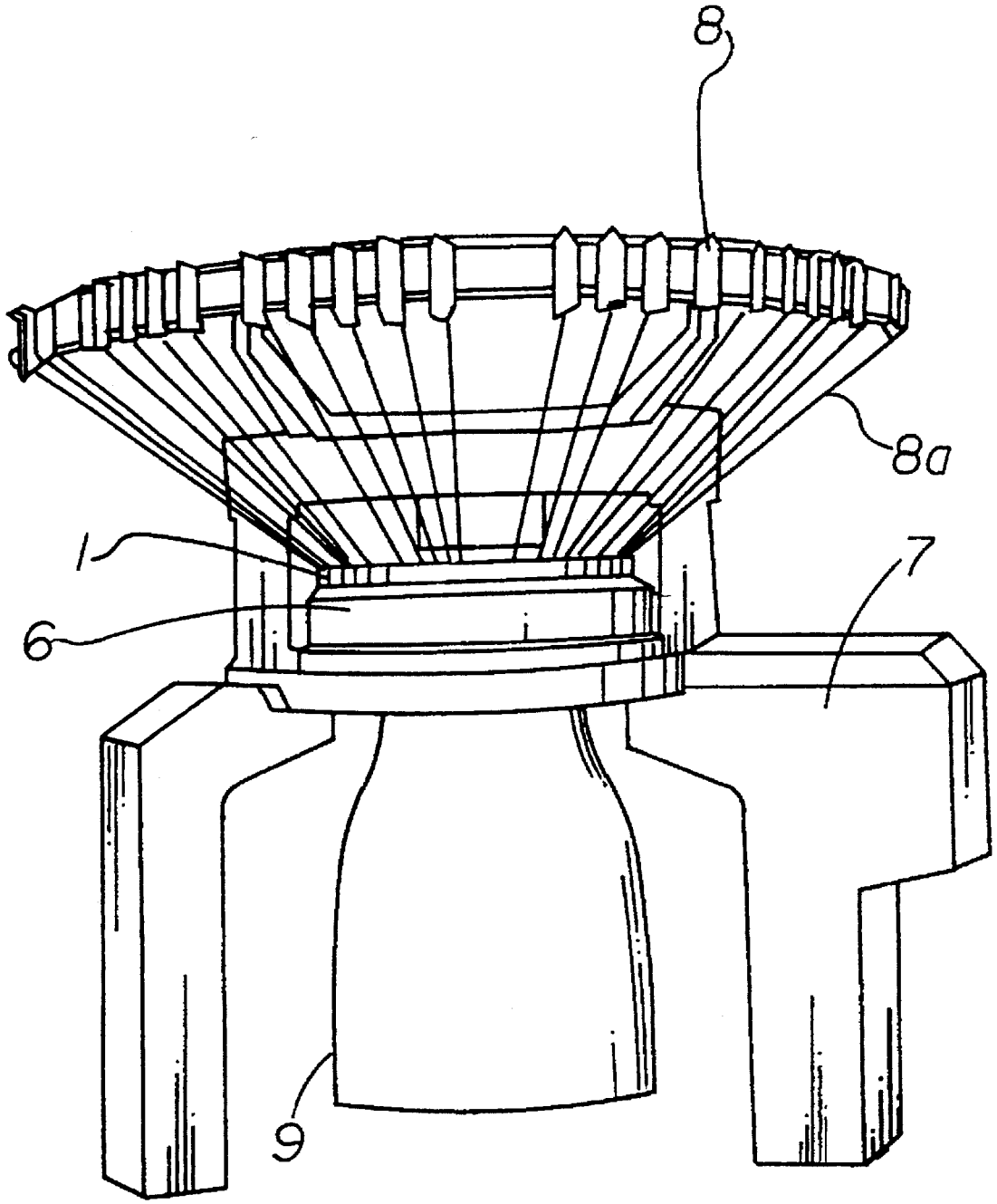
FIG. 5 show a perspective view of an example of a circular knitting machine to which the embodiments of the present invention are applicable.
Figure 6:
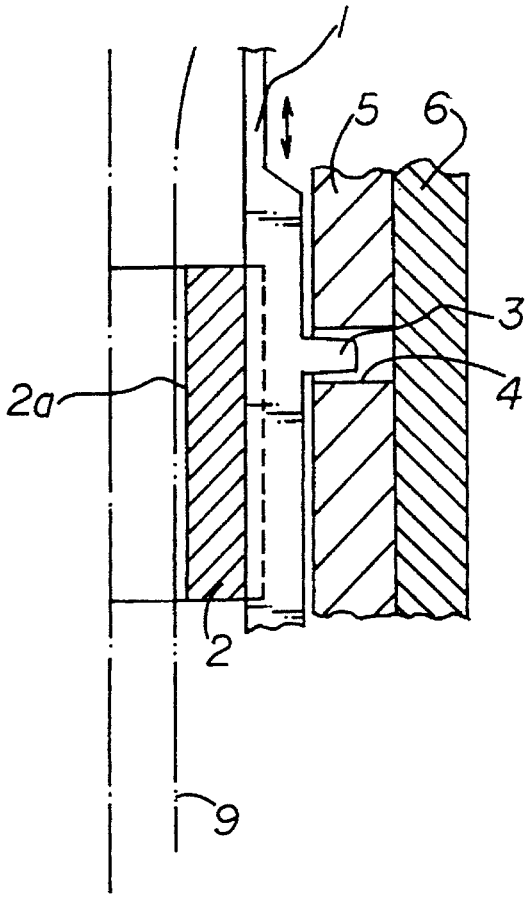
FIG. 6 shows a longitudinal sectional view of a part of the circular knitting machine to which the embodiments of the present invention are applicable.
Figure 7:
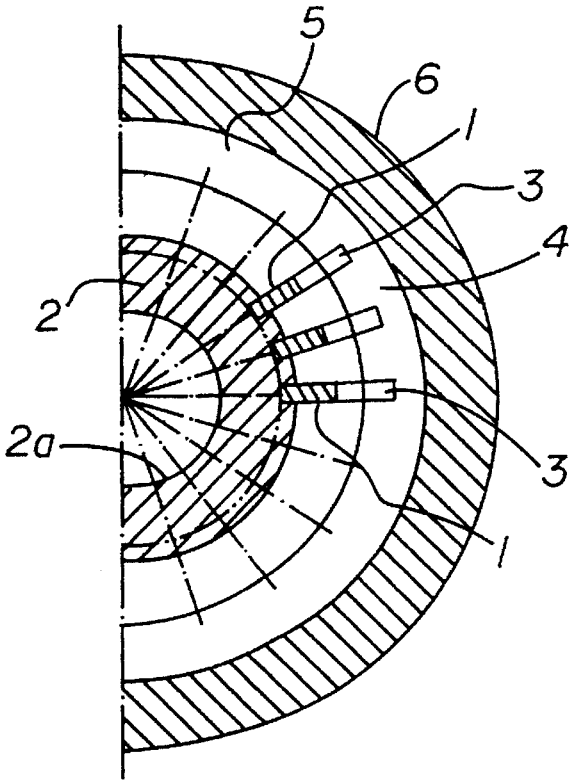
FIG. 7 shows a transverse sectional view of a part of the circular knitting machine to which the embodiments of the present invention are applicable.

A circular knitting machine which utilizes the lubricating method and apparatus of the present invention is shown generally in FIG. 5–7. A circular knitting machine comprises a plurality of needles 1 arranged in a substantially circular row around a periphery of the machine. The needles 1 have projections 3 protruding therefrom. A spline-shaped rotating shaft 2 is provided interior of and in engagement with the row of needles 1 and is rotated so as to revolve the row of needles 1 around the periphery. A drum-shaped cam 5 is provided around the row of needles 1 having a cam groove 4 which engages with projections 3 protruding from the needles 1 so as to move the needles 1 back and forth in the spline of the shaft 2 as the row of needles 1 revolves with the shaft 2. A cam holder 6 is provided around the cam 5 to fixedly hold the cam 5.

With such an arrangement, the needles 1 arranged in a row around a periphery of a circular knitting machine are moved back and forth with the rotation of the shaft 2 so that threads 8*a* supplied from a thread supply source 8 mounted above the base 7 of the machine are knitted. A tubular knitted article 9 is formed which is discharged from a central hollow region 2*a* of the rotating shaft 2. Such an arrangement may comprise a single cam groove 4. Alternatively several cam grooves 4 may be provided to give the projections 3 a different movement for each revolution.

A lubricating method for a circular knitting machine according to an embodiment of the present invention comprises squirting lubricating oil periodically into the cam groove 4 of the cam 5 continuously for a duration of at least one revolution of said row of needles 1 to thereby lubricate the projections 3 of all of the needles 1 and the cam groove 4. Lubrication is then suspended for an intermittent period, until the lubricant is deemed to have been just about used up; then the lubricating oil is again squirted for at least the duration of one revolution. It is preferred that oil not be squirted for fractions of a revolution as this would result in uneven oiling.

Figure 1:
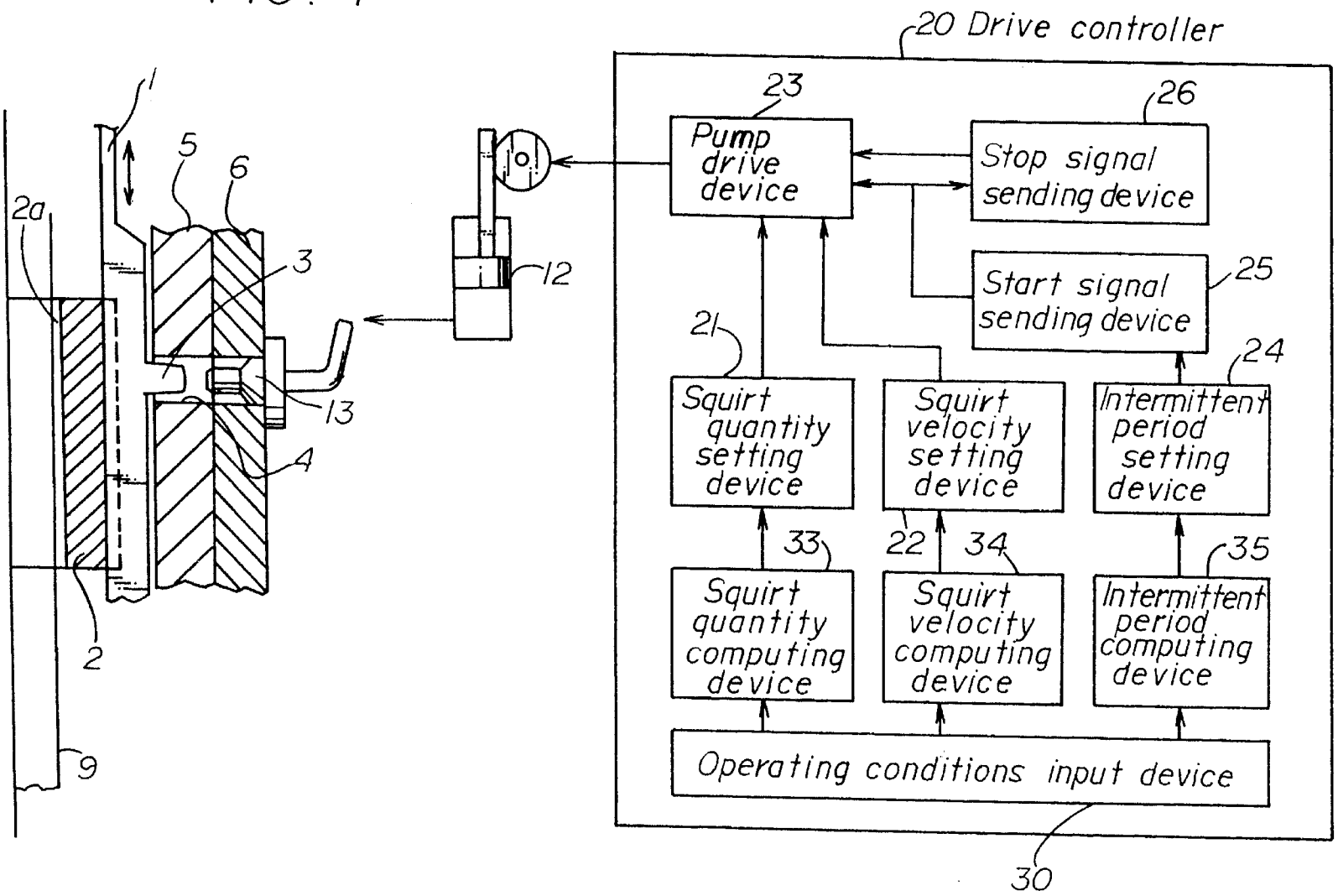
FIG. 1 shows a schematic diagram of a lubricating apparatus for a circular knitting machine according to a first embodiment of the present invention.
Figure 2:
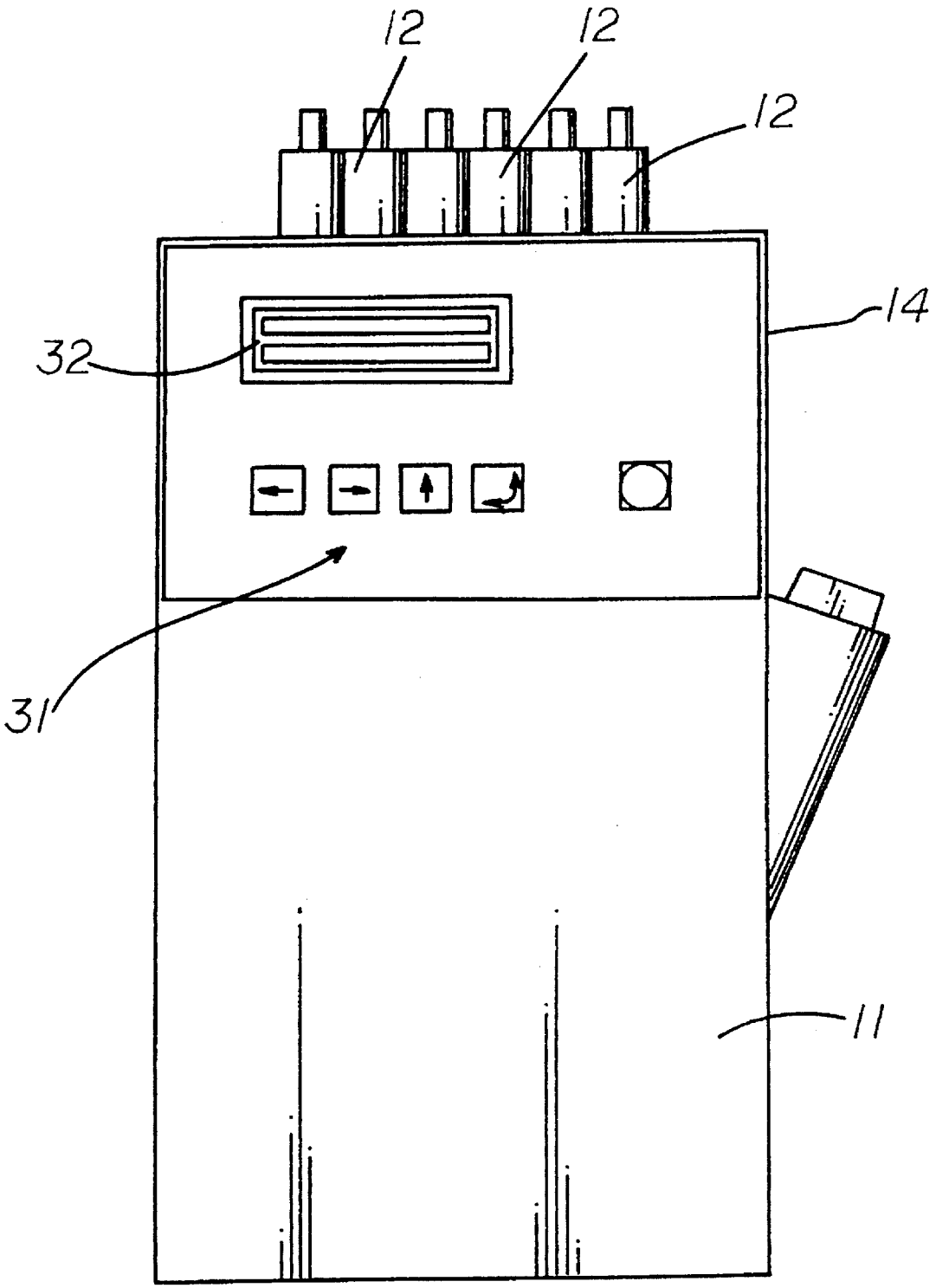
FIG. 2 shows an external view of the lubricating apparatus for the circular knitting machine according to the first embodiment.

A lubricating apparatus according to the present invention is shown generally in FIG. 2. The lubricating apparatus comprises a tank 11 for storing lubricating oil, one or more pumps 12 for pumping the lubricating oil from the tank 11, and one or more nozzles 13 (FIGS. 1, 3, and 4) mounted in one or more cam holders 6. Each nozzle 13 is preferably connected to an associated pump 12 by way of a pipe for squirting lubricating oil into the cam groove 4 of the cam 5. However, it is possible to connect more than one nozzle 13 to a single pump 12.

The pump 12 may be any type of pump which gives variable squirt quantity and squirt velocity. A motor driven plunger pump is preferred, but a gear pump, a vane pump, piston pump and many other kinds of pumps can be used. It has been found that a pump that is capable of supplying from about one cubic centimeter (cc) to about three cc of oil per squirt or per oiling operation is preferred. A plurality of pumps 12 may be provided, six pumps are shown in FIG. 2, arranged in a row. The pumps 12 are supported on a control case 14 which is mounted on top of the tank 11. More or less pumps may be provided based on the number of injection locations for a particular circular knitting machine.

Each pump 12 is adapted for connection to a nozzle 13 by way of a pipe. As shown in FIG. 1, the nozzle 13 is mounted in the cam holder 6 so as to squirt lubricating oil into the cam groove 4 of the cam 5. The nozzles 13 are arranged for example with one nozzle for each cam groove 4 so that several nozzles 13 are provided for several cam grooves 4 of the cam 5 of the circular knitting machine. Alternatively, two or more nozzles 13 may be circumferentially disposed about a single cam groove 4. Each nozzle is connected to a different pump 12. With the present embodiment shown in FIG. 2, up to six nozzles 13 can be fitted. Alternatively, more than one nozzle 13 can be supplied by one pump 12.

Referring now to FIG. 1 a drive control section 20 for operating the pumps 12 is disposed within a control case 14 (FIG. 2). The drive control section 20 provides intermittent drive control of the pump 12 so that lubricating oil is squirted from the nozzle 13 during a squirting or oiling operation for a duration of at least one revolution of the row of needles—typically, about six seconds— at adjustable intervals or intermittent periods between successive squirting or oiling operations of about one to about fifteen minutes, depending upon a great many factors. Just a few of the factors affecting the quantity, velocity and frequency of squirt operations are, speed of rotation of the shaft 2, diameter of the cam 4, number of needles 1, viscosity of the oil, boundary-layer lubricity of the oil, environmental temperature, etc., all of which are within the knowledge and experience of a practitioner in the machine knitting art.

As shown in FIG. 1, the drive control section 20 comprises a squirt quantity setting device 21 for setting the quantity of oil per squirt or per squirt operation, a squirt velocity setting device 22 for setting the squirt velocity of pump 12, and a pump drive device 23 incorporating, for example, a motor, for driving the pump 12. An intermittent period setting device 24 is also included in the drive control section for setting the interval between successive oil squirt operations by the pump 12. A start signal sending device 25 for sending a start signal at the end of each intermittent period, and a stop signal sending device 26 for sending a stop signal to the pump drive device after completion of one squirt, so as to give the aforementioned set squirt quantity and squirt velocity.

The drive control section 20 may further comprise an operating conditions input device 30 for inputting the operating conditions of the circular knitting machine, such as those mentioned above. The operating conditions input device 30, as shown in FIG. 1, is provided on the front face of the control case 14. The operating conditions input device 30 comprises input keys 31 for inputting such parameters as the rotational speed of the rotating shaft 2 and the diameter of the circular knitting machine. A display section 32, also shown in FIG. 1, may also be provided on the front face of the control case 14 for displaying the operating parameters as they are inputted with the input keys 31.

The drive control section 20, as shown in FIG. 1, also comprises a squirt quantity computing device 33 for computing the squirt quantity of the pump 12 per squirt on the basis of the operating conditions input to the operating conditions input device 30. Similarly, a squirt velocity computing device 34 computes the squirt velocity needed on the basis of the operating conditions inputted at the operating conditions device 30. The squirt velocity computing device 34 computes a squirt velocity for the lubricating oil to be squirted from the nozzles 13 for a duration of at least one revolution of the row of needles. An intermittent period computing device 35 is also included for computing, on the basis of the operating conditions inputted to the operating conditions input device 30, the operating period between successive continuous oiling operations of the pump 12, which is set in the intermittent period setting device 24.

The various functions of the drive control section 20, as mentioned above, are realized by an internal CPU and simple program steps. With the circular knitting machine lubricating apparatus according to the embodiment shown in FIG. 1, the operating conditions of the circular knitting machine, namely the rotational speed of the rotating shaft 2 and the diameter of the circular knitting machine, are preliminarily inputted and indicated on the display section 32.

For example, the linear speed of the needles 1 can easily be calculated by a simple multiplication from the diameter of the needle assembly and the rotational speed of the shaft 2. Similarly, the time period for a single revolution can easily be calculated by a simple mathematical division operation from the rotational speed of the shaft 2. From these two factors, and from an operator judgment of how much oil is to be squirted on each needle and the number of needles, a quantity of oil to be continuously squirted in one shaft rotation is calculable. With that quantity of oil desired and the duration of each rotation of the shaft and the characteristics of the nozzle 13, the squirt velocity can be calculated. Experience of a practitioner can then determine how many rotations of the shaft will usually result in consumption of the quantity of oil squirted on each needle. That, together with the speed of rotation of the shaft 2 and the diameter of the cam 5 will determine the length of the intermittent period before oil must again be squirted into the cam groove 4. This can even be programmed into a look-up table that is stored, for example, in a read-only memory integrated circuit.

If a linear plunger pump, e.g., like a syringe driven by a gearmotor, is used, the length of the stroke is preferably variable for achieving a variable quantity of oil per squirt, either preset at the beginning of a pump stroke or by controlling the speed of the pump stroke. The speed of the gearmotor for that quantity during the time for one rotation of the shaft 2 gives the velocity of the squirt. Then, the length of the interval in which electric power is applied to the pump motor determines the duration of the squirt operation to oil all of the needles.

As a result, an appropriate squirt quantity of pump 12 per one squirt is computed by the squirt quantity computing device 33 and set in the squirt quantity setting device 21. A squirt velocity of pump 12 is computed by the squirt velocity computing device 34 and set in the squirt velocity setting device 22. Furthermore, an intermittent period between squirt operations is computed by the intermittent period computing device 35 and set in the intermittent period setting device 24.

Subsequently, a start signal to start the pump 12 and perform an oil squirt operation is sent from the start signal sending device 25 to the pump drive device 23 after an intermittent period. The same start signal is preferably also sent to the stop signal sending device 26 in order to prime or prepare the stop signal sending device 26 to stop the pump 12 and end the oil squirt operation, after the oil squirt operation has squirted oil on all of the needles 1, preferably by measuring or calculating the time required by at least one revolution of the shaft 2.

The pump drive device 23 drives the pump 12 in response to the start signal so as to give the above-mentioned set squirt quantity and squirt velocity. Then, on completion of one squirt, at the end of at least one rotation of the shaft 2, a stop signal is sent from the stop signal sending device 26 to stop the pump drive device 23, preferably after the squirt has continued for a single rotation of the shaft 2. The pump 12 thus pauses until the next start signal following the next intermittent period.

During each oiling operation of the pump 12, a set squirt quantity of lubricating oil is discharged from the pump 12 and squirted at a set velocity from the nozzle 13 into the cam groove 4 of the cam 5. The squirt velocity is set so that the lubricating oil is squirted for a duration of at least one revolution of the row of needles. The lubricating oil is supplied to all of the plurality of projections on the needles inside the peripheral cam groove 4. Consequently, the lubricating oil is uniformly spread and the condition of nonuniform lubrication prevented. Furthermore, since the delivery system is not via compressed air and squirt quantity and intermittent period are appropriately set, lubricating oil is not scattered to the surrounding area and consequent contamination is stopped.

Oil wastage is much minimized compared to the continuous spray type lubricating system. Machine durability can be greatly enhanced with only a small yet adequate supply of lubricating oil uniformly applied to all of the required parts, compared with the pulsed system which sprays pulses of lubricating oil for only small fractions of a revolution and depends upon statistical distribution to average out the lubrication of the several needles. Moreover, since the circular knitting machine operating conditions are inputted, and the squirt quantity, squirt velocity, and intermittent period are thereby computed and set, appropriate lubrication to suit the circular knitting machine operating conditions is automatically carried out with the lubricating oil being reliably supplied to the cam groove 4.

Figure 3:
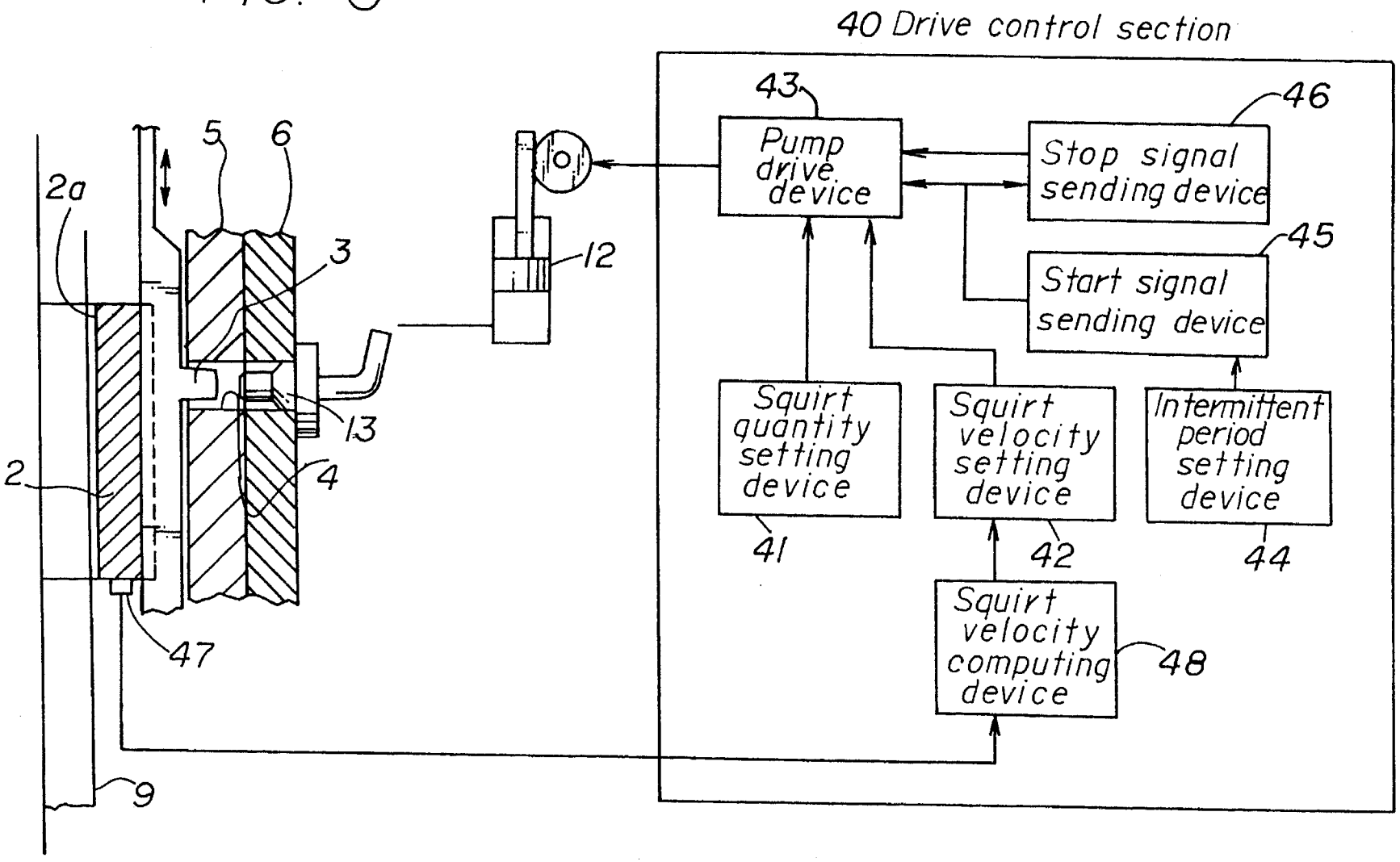
FIG. 3 shows a schematic diagram of a lubricating apparatus for a circular knitting machine according to a second embodiment of the present invention.

FIG. 3 shows a lubrication apparatus for a circular knitting machine according to a second embodiment of the present invention. The second embodiment is equipped with a pump 12 and nozzle 13 as described above. The drive control section 40 of the pump 12 provides intermittent drive control of the pump 12, so that lubricating oil is squirted from the nozzle 13 for a duration of at least one revolution of the row of needles. More specifically, as shown in FIG. 3, the drive control section 40 comprises a squirt quantity setting device 41 for setting the squirt quantity of pump 12 per squirt, a squirt velocity setting device 42 for setting the squirt velocity of the pump 12, and a pump drive device 43 incorporating for example a motor, for driving the pump 12.

An intermittent period setting device 44 manually sets an intermittent operating period between successive operations of pump 12. A start signal sending device 45 sends a start signal after each intermittent period and also primes a stop signal sending device 46 eventually to stop the pump drive device 43. After the pump has squirted oil through the nozzle 13 for at least one rotation of the shaft 2, the stop signal sending device 46 sends a stop signal to the pump drive device 43 in order to stop the pump 12 after completion of one oil squirt operation.

The drive control section 40 of the embodiment shown in FIG. 3 further comprises a revolution speed detection device 47 for detecting the revolution speed of the row of needles 1, and a squirt velocity computing device 48 for computing the squirt velocity of pump 12 on the basis of the revolution speed detected by the revolution speed detection device 47 which is set in the squirt velocity setting device 42. The squirt velocity computing device 48 computes a squirt velocity so that for example, when the detected revolution speed is 10 rpm, the lubricating oil is squirted for 6 seconds during one revolution of the needle row 1. As a result, the lubricating oil is supplied to all of the plurality of projections 3 on the needles 1 inside the peripheral cam groove 4. Consequently the lubricating oil is uniformly spread, and the condition of nonuniform lubrication is prevented. Since the revolution speed is actually measured so as to compute the squirt velocity desired, even if the rotational speed of the rotating shaft 2 varies, it is automatically accommodated without requiring manual resetting and correction. Efficiency is thereby improved.

Figure 4:
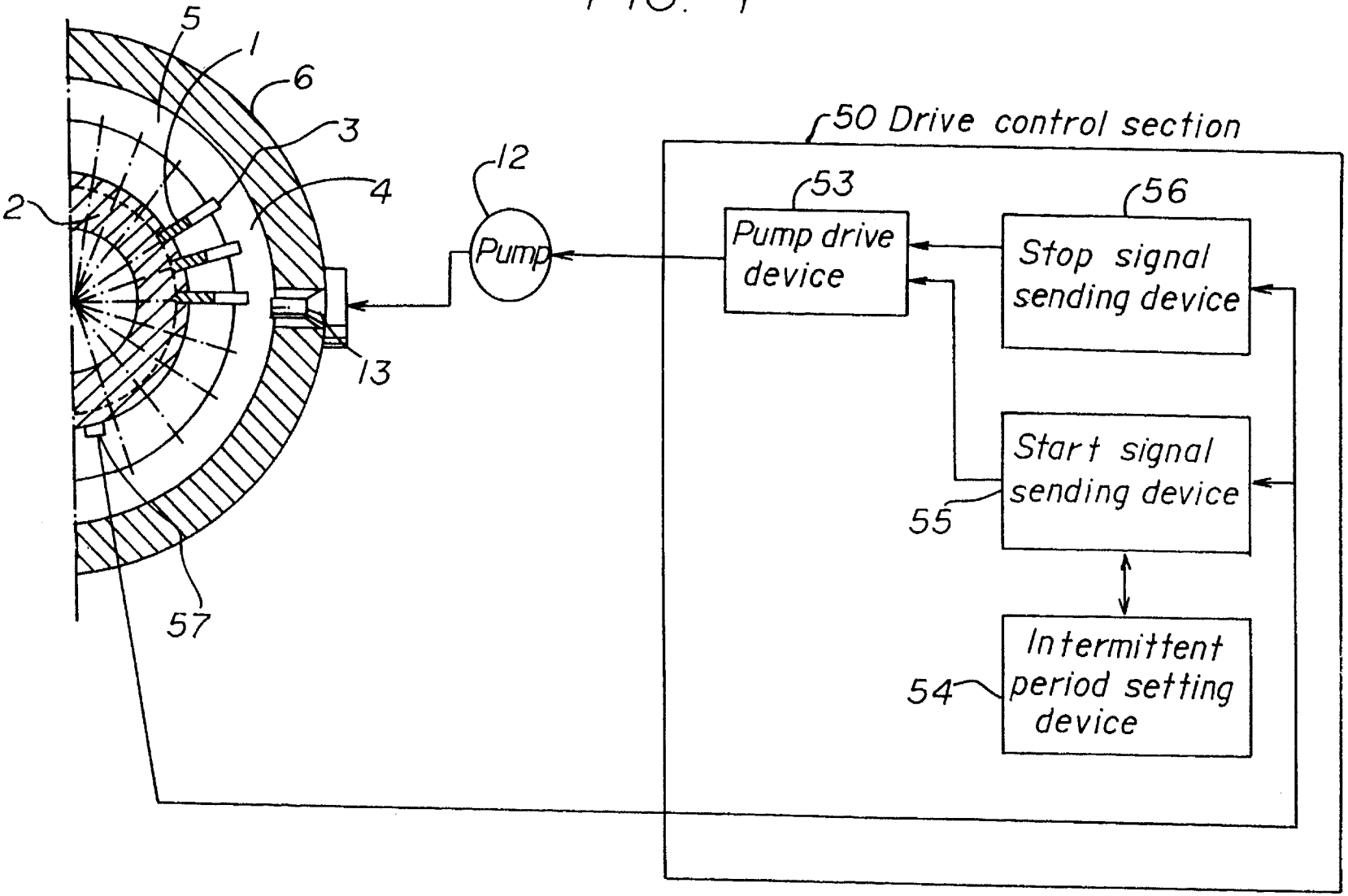
FIG. 4 shows a schematic diagram of a lubricating apparatus for a circular knitting machine according to a third embodiment of the present invention.

FIG. 4 shows a lubrication apparatus for a circular knitting machine according to a third embodiment of the present invention. The third embodiment is equipped with a pump 12 and nozzle 13 as described above. The drive control section 50 of the pump 12 provides intermittent drive control for the pump 12, so that lubricating oil is squirted from the nozzle 13 for a duration of at least one revolution of the row of needles. More specifically, as shown in FIG. 4, the drive control section 50 comprises, a pump drive device 53 for driving the pump 12 in response to a start signal and stopping the pump at the time of a stop signal. An intermittent period setting device 54 for setting an intermittent operating period between oil squirt operations is provided.

A start signal sending device 55 sends a start signal at the end of each intermittent period. A revolution position detection device 57 detects a revolution position of the row of needles 1. When the intermittent period setting device 54 (a timer) signals that a another oil squirt operation is needed, it enables the start signal sending device 55 to accept the next signal from the revolution position detection device 57 and start an oil squirt operation. Therefore, the oil squirt operation is started at a fixed angular position of the shaft 2.

The start of an oil squirt operation—or some other fixed time in an oil squirt operation—restarts the intermittent period setting device 54 to begin timing the time interval before the start of the next succeeding oil squirt operation. Also, the start of the intermittent period setting device 54 makes the start signal sending device 55 unresponsive to subsequent signals from the revolution position detection device 57 until the end of that next intermittent period.

A stop signal sending device 56 sends a stop signal on the basis of the revolution position information detected by the revolution position detection device 57. The stop signal sending device 56 is set each time that the revolution position detecting device 57 senses that the row of needles has reached the same specific revolution position at which an oil squirt operation was started. Therefore, the stop signal sending device 56 sends a stop signal when the shaft 2 has rotated through at least 360 degrees from when the start signal sending device 55 was last triggered by the revolution position detection device 57.

As a result, lubricating oil is squirted from the nozzle 13 for a duration of at least one revolution of the row of needles, so that the lubricating oil is applied to all of the plurality of projections 3 on the needles 1 inside the peripheral cam groove 4. Consequently the lubricating oil is uniformly spread, and the condition of nonuniform lubrication prevented. Moreover, since the rotation position of the rotating shaft is actually measured, then even if the rotational speed of the rotating shaft varies, this is thus automatically accommodated without requiring manually resetting and correction. Efficiency is thereby improved.

The revolution position detection device 57 sends the same set or trigger signal simultaneously to both the start signal sending device 55 and the stop signal sending device 56. Therefore, the pump drive device 53 can receive both a start signal and a stop signal at the same instant. In order to avoid confusion of the pump drive device 53 that might result from such contention between the simultaneous arrival of shaft angular position signals from the revolution position detection device 57, the pump drive device 53 can be made more receptive to a start signal than to a stop signal. Alternatively, the intermittent period setting device can be arranged to make the stop signal sending device 56 insensitive to the output of the revolution position detection device 57 at the same time as the intermittent period setting device 54 makes the start signal sending device 55 sensitive to the output of the revolution position detection device 57.

With the lubricating method and apparatus for a circular knitting machine according to the present invention, as described above, lubricating oil is squirted into the cam groove 4 of the circular knitting machine for a duration of at least one revolution of the row of needles. In this manner, lubricating oil is supplied to all of the plurality of projections 3 on the needles 1 inside the peripheral cam groove. As a result, lubricating oil is uniformly spread to all required locations without lubricating oil contamination of the surrounding area. The occurrence of nonuniform lubrication is thereby prevented. Also, due to the intermittent oiling operation, oil wastage becomes practically zero compared to the continuous spray type lubricating system. Machine durability is ensured with only a small yet adequate supply of lubricating oil uniformly applied to all of the required parts.

Furthermore, when the squirt quantity, squirt velocity and intermittent period between successive oil squirt operations are set by means of the drive control section, the pump drive device is operated automatically so as to give the set squirt quantity and squirt velocity. Consequently, lubricating oil is reliably supplied to the cam groove. When the circular knitting machine operating conditions are inputted to the drive control section, and the squirt quantity, squirt velocity, and intermittent period are computed, appropriate lubrication to suit the circular knitting machine operating conditions is automatically carried out.

Also, when rotational speed or position of the rotating shaft is actually measured so as to compute the squirt velocity, then even if the revolution speed of the circular knitting machine varies, proper lubrication can be automatically accommodated without requiring manual setting and correction, so that with this alone efficiency is improved.

What is claimed is:

1. A lubricating method for a circular knitting machine, said knitting machine comprising a plurality of needles arranged for revolution around a periphery or the machine, said needles having projections;

a drum-shaped cam provided around the needles, the drum-shaped cam having a cam groove which engages with the projections protruding from the needles for moving the needles back and forth when the needles revolve;

said lubricating method comprising:

providing means for periodically squirting lubricating oil into said cam groove of the cam continuously for a duration of at least revolution of said needles around the periphery of the machine; providing means for stopping and starting the lubricating oil spraying means based on the revolution position of the row of needles; and periodically squirting lubricating oil into said cam groove of the cam continuously for a duration of at least one revolution of said needles around the periphery of the machine to thereby lubricate said projections and cam groove.

2. A lubricating apparatus for a circular knitting machine, said knitting machine comprising a plurality of needles arranged for revolution around a periphery of the machine, said needles having projections;

a drum-shaped cam around the needles, the drum-shaped cam having a cam groove which engages with the projections protruding from the needles for moving the needles back and forth when the needles revolve;

said lubricating apparatus comprising:

a. a nozzle arranged to squirt lubricating oil into the cam groove of the cam;

b. a pump for supplying lubricating oil to the nozzle; and c. means for controlling the pump for periodically squirting lubricating oil from the nozzle continuously for a duration of at least one revolution of the needles around the periphery of the machine, wherein said pump controlling means comprises, means for setting a pump squirt quantity per spray, means for setting a pump squirt velocity, means for setting an intermittent pump operating period between successive squirts, means for sending a start signal for starting a squirt after each intermittent period means for sending a stop signal after completion of said squirt, but not before the completion of one revolution of said needles around said cam following said start signal, and means for driving the pump so as to start the pump at the time of said start signal and stop the pump at the time of said stop signal and for providing said squirt quantity and said squirt velocity.

3. The lubricating apparatus for a circular knitting machine according to claim 2, wherein said pump controlling means further comprises:

a. means for inputting operating conditions of the circular knitting machine;

b. means for computing the pump squirt quantity per squirt on the basis of the operating conditions inputted to the operating conditions inputting means for setting said pump squirt quantity setting means;

c. means for computing the pump squirt velocity on the basis of the operating conditions input to the operating conditions inputting means for setting said squirt velocity setting means; and d. means for computing the intermittent pump operating period between squirts on the basis of the operating conditions inputted to the operating conditions inputting means for setting said intermittent pump operating period setting means.

4. The lubricating apparatus for a circular knitting machine according to claim 2, wherein said pump controlling means further comprises:

a. means for detecting the revolution speed of the row of needles, and b. means for computing the pump squirt velocity on the basis of the revolution speed detected by the revolution speed detecting means for setting said squirt velocity setting means.

5. A lubricating apparatus for a circular knitting machine, said knitting machine comprising a plurality of needles arranged for revolution around a periphery of the machine, said needles having projections;

a drum-shaped cam around the needles, the drum-shaped cam having a cam groove which engages with the projections protruding from the needles for moving the needles back and forth when the needles revolve;

said lubricating apparatus comprising:

a. a nozzle arranged to squirt lubricating oil into the cam groove of the cam;

b. a pump for supplying lubricating oil to the nozzle; and c. means for controlling the pump for periodically squirting lubricating oil from the nozzle continuously for a duration of at least one revolution of the needles around the periphery of the machine, wherein said pump controlling means comprises:

means for driving the pump so as to start at the time of a start signal and stop at the time of a stop signal;

means for setting an intermittent pump operating period between successive operations of the pump;

means for sending a start signal after each intermittent period;

means for detecting the revolution position of the row of needles: and means for sending a stop signal on the basis of the position information detected by the revolution position detection means.

6. A lubricating method for a circular knitting machine, said knitting machine comprising a plurality of needles arranged for revolution around a periphery of the machine, said needles having projections;

a drum-shaped cam provided around the row of needles, the drum-shaped cam having a cam groove which engages with the projections protruding from the needles for moving the needles back and forth when the needles revolve;

said lubricating method comprising:

providing means for squirting lubricating oil into said cam groove of the cam, periodically squirting lubricating oil into said cam groove of the cam continuously for a duration of at least one revolution of said needles around the periphery of the machine to thereby lubricate said projections and cam groove, controlling the lubricating oil squirting means for periodically squirting lubricating oil continuously for a duration of at least one revolution of the needles around the periphery of the machine, wherein the step of controlling the lubricating oil squirting means comprises.

setting a lubricating oil squirting mean squirt quantity per squirt, setting a lubricating oil squirting means squirt velocity, setting an intermittent lubricating oil squirting means operating period between successive squirts, sending a start signal for starting a squirt after each intermittent period, sending a stop signal after completion of said squirt but not before the completion of one revolution of said needles around said cam following said start signal, and driving the lubricating oil squirting means so as to start the lubricating oil squirting means at the time of said start signal and stop the lubricating oil squirting means at the time of said stop signal and for providing said squirt quantity and said squirt velocity.

7. A method for controlling squirt quantifies of lubricating oil in a circular knitting machine, wherein the circular knitting machine comprises:

a plurality of needles vertically movably arranged in a row around said knitting machine, the plurality of needles arranged for revolution around a periphery of the machine, said needles having projections;

a dram-shaped cam provided around the needles, the drum-shaped cam having a cam groove which engages with the projections protruding from the needles for moving the needles back and forth when the needles revolve;

said lubricating method comprising:

providing control means for periodically squirting lubricating oil into said cam groove of the cam continuously for a duration of at least one revolution of said needles around the periphery of the machine;

providing a timer for stopping squirting of lubricating oil after a duration of at least one revolution of said needles around the periphery of the machine and for starting squirting of lubricating oil after a stopping period set by said timer; and periodically squirting lubricating oil into said cam groove of the cam continuously for a duration of at least one revolution of said needles around the periphery of the machine to lubricate said projections and cam groove.

8. A lubricating apparatus for a circular knitting machine, said knitting machine comprising:

a plurality of needles arranged for revolution around a periphery of the machine, said needles having projections;

a drum-shaped cam around the needles, the drum-shaped cam having a cam groove which engages with the projections protruding from the needles for moving the needles back and forth when the needles revolve;

said lubricating apparatus comprising:

a. a nozzle arranged to squirt lubricating oil into the cam groove of the cam;

b. a pump for supplying lubricating oil to the nozzle; and c. means for controlling the pump for periodically squirting lubricating oil from the nozzle continuously for a duration of at least one revolution of the needles around the periphery of the machine, wherein said pump controlling means comprises:

means for setting a pump squirt quantity per squirt;

means for setting a pump squirt velocity;

means for setting an intermittent pump operating period between successive squirts;

a timer for the intermittent pump operating period and for starting the lubricating oil control means at the termination of the intermittent pump operating period;

means for sending a start signal for starting a squirt after each intermittent period;

means for sending a stop signal after completion of a squirt period set by the timer, but not before the completion of one revolution of said needles around said cam following said start signal; and means for driving the pump so as to start the pump at the time of said start signal and stop the pump at the time of said stop signal and for providing said squirt quantity and said squirt velocity.

9. A lubricating apparatus for a circular knitting machine, said knitting machine comprising:

a plurality of needles arranged for revolution around a periphery of the machine, said needles having projections;

a drum-shaped cam around the needles, the drum-shaped cam having a cam groove which engages with the projections protruding from the needles for moving the needles back and forth when the needles revolve;

said lubricating apparatus comprising:

a. a nozzle arranged to squirt lubricating oil into the cam groove of the cam;

b. a pump for supplying lubricating oil to the nozzle; and c. a timer means for controlling the pump for periodically squirting lubricating oil from the nozzle continuously for a duration of at least one revolution of the net, dies around the periphery of the machine, wherein said time means comprises:

a timer for driving the pump so as to start the pump at the time of a start signal and stop the pump at the time of a stop signal, and for setting an intermittent pump operating period between successive operations of the pump;

means for sending a start signal after each intermittent pump operating period;

means for setting a stopping period by said timer according to a predetermined operating cycle; and means for sending a stop signal at a predetermined time set by said timer after a duration of at least one revolution of said needles around the periphery of the machine.

10. An apparatus for controlling squirt quantities of lubricating oil in a circular knitting machine, wherein the circular knitting machine comprises:

a plurality of needles vertically, movably arranged in a row around said knitting machine, the plurality of needles arranged for revolution around a periphery of the machine, said needles having projections;

a drum-shaped cam around the needles, the drum-shaped cam having a cam groove which engages with the projections protruding from the needles for moving the needles back and forth when the needles revolve;

said lubricating apparatus comprising:

means for controlling the periodic squirting of lubricating oil into said cam groove of the cam continuously for a duration of at least one revolution of said needles around the periphery of the machine; and a timer for stopping the squirting of lubricating oil after a duration of at least one revolution of said needles around the periphery of the circular knitting machine and for starting the squirting of the lubricating oil control means after a predetermined period set by said timer, thereby periodically repeating the squirting of lubricating oil into said cam groove of the cam continuously for a duration of at least one revolution of said needles around the periphery of the machine to lubricate said projections and cam groove and stopping the squirting of lubricating oil at the onset of a stopping period set by said timer.

* * * * *